US007958901B2

(12) United States Patent
Lai

(10) Patent No.: US 7,958,901 B2
(45) Date of Patent: Jun. 14, 2011

(54) UMBRELLA HAVING AN ANGLE ADJUSTABLE FUNCTION

(75) Inventor: Jin-Sheng Lai, Taipei (TW)

(73) Assignee: Galtech Computer Corp., Newbury Park, CA (US)

( * ) Notice: Subject to any disclaimer, the term of this patent is extended or adjusted under 35 U.S.C. 154(b) by 140 days.

(21) Appl. No.: 12/414,886

(22) Filed: Mar. 31, 2009

(65) Prior Publication Data

US 2010/0243009 A1 Sep. 30, 2010

(51) Int. Cl.
*A45B 17/00* (2006.01)

(52) U.S. Cl. ..... 135/20.3

(58) Field of Classification Search ..... 135/114, 135/20.1, 21, 20.3
See application file for complete search history.

(56) References Cited

U.S. PATENT DOCUMENTS

| | | | | | |
|---|---|---|---|---|---|
| 2,607,363 | A * | 8/1952 | Frey | 135/74 |
| 3,145,720 | A * | 8/1964 | Torii | 135/20.3 |
| 3,150,671 | A * | 9/1964 | Frey | 135/20.3 |
| 3,175,568 | A * | 3/1965 | Kafka | 135/20.3 |
| 3,311,119 | A * | 3/1967 | Pearlstine | 135/20.3 |
| 3,410,285 | A * | 11/1968 | Small | 135/20.3 |
| 3,926,202 | A * | 12/1975 | Uthemann et al. | 135/20.3 |
| 6,014,980 | A * | 1/2000 | Glatz | 135/20.1 |
| 6,311,705 | B1 * | 11/2001 | Ma | 135/20.3 |
| 6,478,037 | B2 * | 11/2002 | Tung | 135/21 |
| 6,761,180 | B1 * | 7/2004 | Lai | 135/20.3 |
| 2004/0035452 | A1 * | 2/2004 | Ma | 135/20.3 |
| 2008/0041431 | A1 * | 2/2008 | Tung | 135/21 |

* cited by examiner

*Primary Examiner* — David Dunn
*Assistant Examiner* — Noah Chandler Hawk
(74) *Attorney, Agent, or Firm* — Alan Kamrath; Kamrath & Associates PA

(57) ABSTRACT

A umbrella includes an upright post, a swing mechanism pivotally mounted on the upright post, a frame mounted on the swing mechanism to pivot in concert with the swing mechanism relative to the upright post, and a driving mechanism mounted on the upright post and connected with the swing mechanism to drive the swing mechanism to pivot relative to the upright post. Thus, the frame is rolled relative to the upright post to tilt leftward or rightward to adjust the inclined angle of the skeleton of the frame so as to provide a better shading effect.

18 Claims, 10 Drawing Sheets

A

UMBRELLA HAVING AN ANGLE ADJUSTABLE FUNCTION

BACKGROUND OF THE INVENTION

1. Field of the Invention

The present invention relates to a shading device and, more particularly, to an umbrella or a sunshade to provide a shading function.

2. Description of the Related Art

A conventional umbrella comprises an upright post and a frame mounted on the upright post. The frame includes a mounting bracket secured on and supported by the upright post, a support shank extending through the mounting bracket, a skeleton foldably mounted on an upper end of the support shank, a canopy mounted on the skeleton, a grip portion mounted on a lower end of the support shank, and an elbow link having a lower end pivotally connected with the upright post and an upper end pivotally connected with the grip portion. Thus, the canopy mounted on the skeleton can be opened to provide a shading effect to a user. However, the frame is securely mounted on the upright post so that the canopy mounted on the skeleton has a fixed angle that cannot be adjusted according to the practical situation, thereby limiting the shading effect of the umbrella when the sunshine or rain is directed in an oblique angle.

BRIEF SUMMARY OF THE INVENTION

In accordance with the present invention, there is provided an umbrella, comprising an upright post, a swing mechanism pivotally mounted on the upright post, a frame mounted on the swing mechanism to pivot in concert with the swing mechanism relative to the upright post, and a driving mechanism mounted on the upright post and connected with the swing mechanism to drive the swing mechanism to pivot relative to the upright post.

The swing mechanism includes a pivot seat pivotally mounted on the upright post, a pull bar having an upper end pivotally connected with the pivot seat to drive the pivot seat to pivot relative to the upright post, and a driven rod having an upper end connected with a lower end of the pull bar to drive and move the pull bar and a lower end that is driven by the driving mechanism to move upward and downward relative to the upright post. The lower end of the driven rod is provided with an outer thread.

The driving mechanism includes a housing secured to the upright post, a driven nut rotatably mounted in the housing and screwed onto the outer thread of the driven rod, a driven gear rotatably mounted in the housing and secured on the driven nut to drive the driven nut to rotate relative to the driven rod, a drive gear meshing with the driven gear to drive the driven gear to rotate relative to the driven rod, a propeller shaft secured on the drive gear to rotate the drive gear, and a rocker arm secured on the propeller shaft to rotate the propeller shaft.

The primary objective of the present invention is to provide an umbrella having an angle adjustable function.

Another objective of the present invention is to provide an umbrella that is operated easily and conveniently to adjust its inclined angle.

A further objective of the present invention is to provide an umbrella, wherein the frame is rolled relative to the upright post to tilt leftward or rightward to adjust the inclined angle of the skeleton of the frame so as to provide a better shading effect.

A further objective of the present invention is to provide an umbrella, wherein the user only needs to drive the rocker arm to change and adjust the inclined angle of the frame, so that the inclined angle of the frame can be adjusted easily and quickly.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
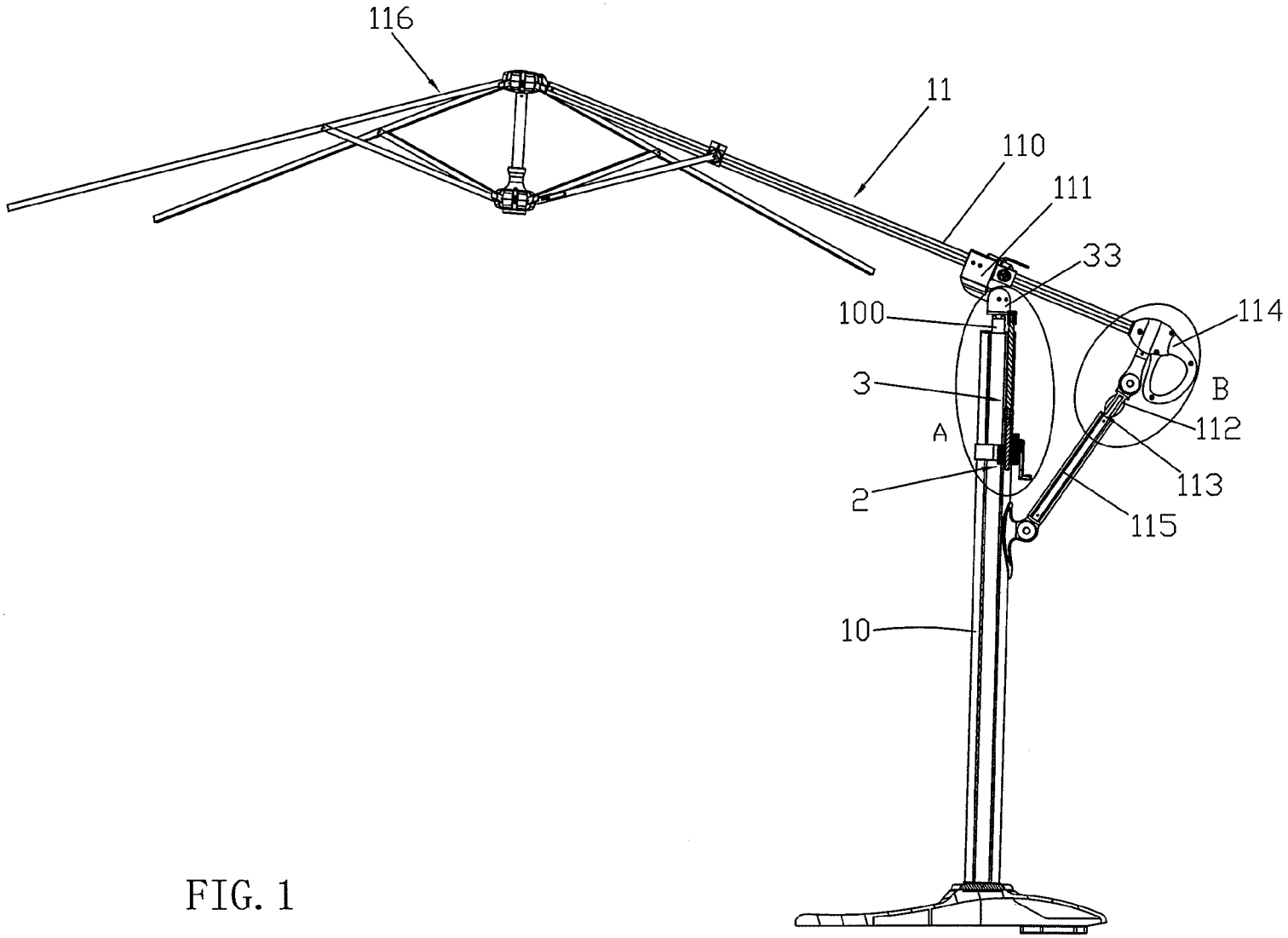
FIG. 1 is a partially side cross-sectional view of an umbrella in accordance with the preferred embodiment of the present invention.
Figure 2:
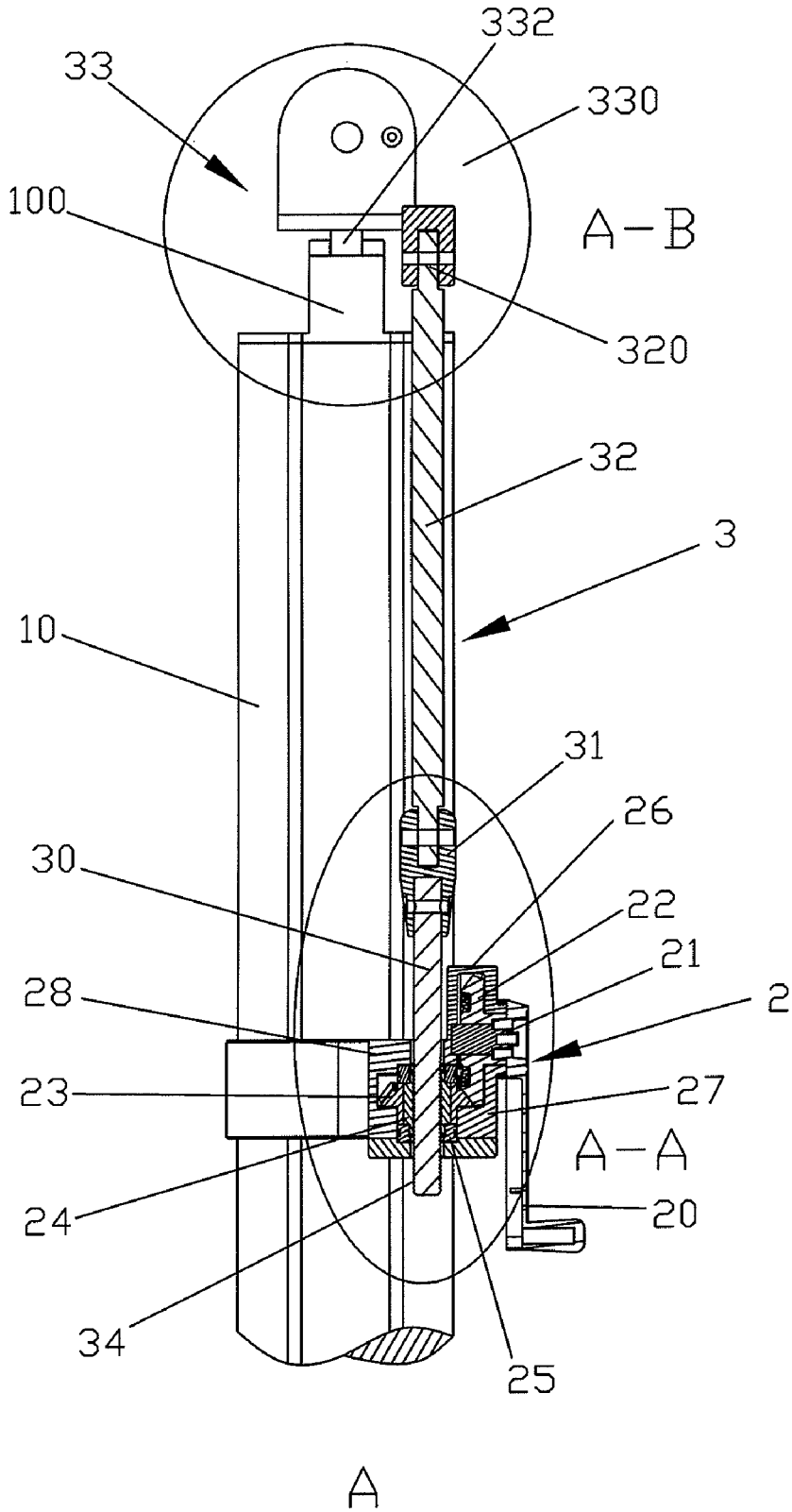
FIG. 2 is a locally enlarged view of the umbrella taken along an oblong mark "A" as shown in FIG. 1.
Figure 3:
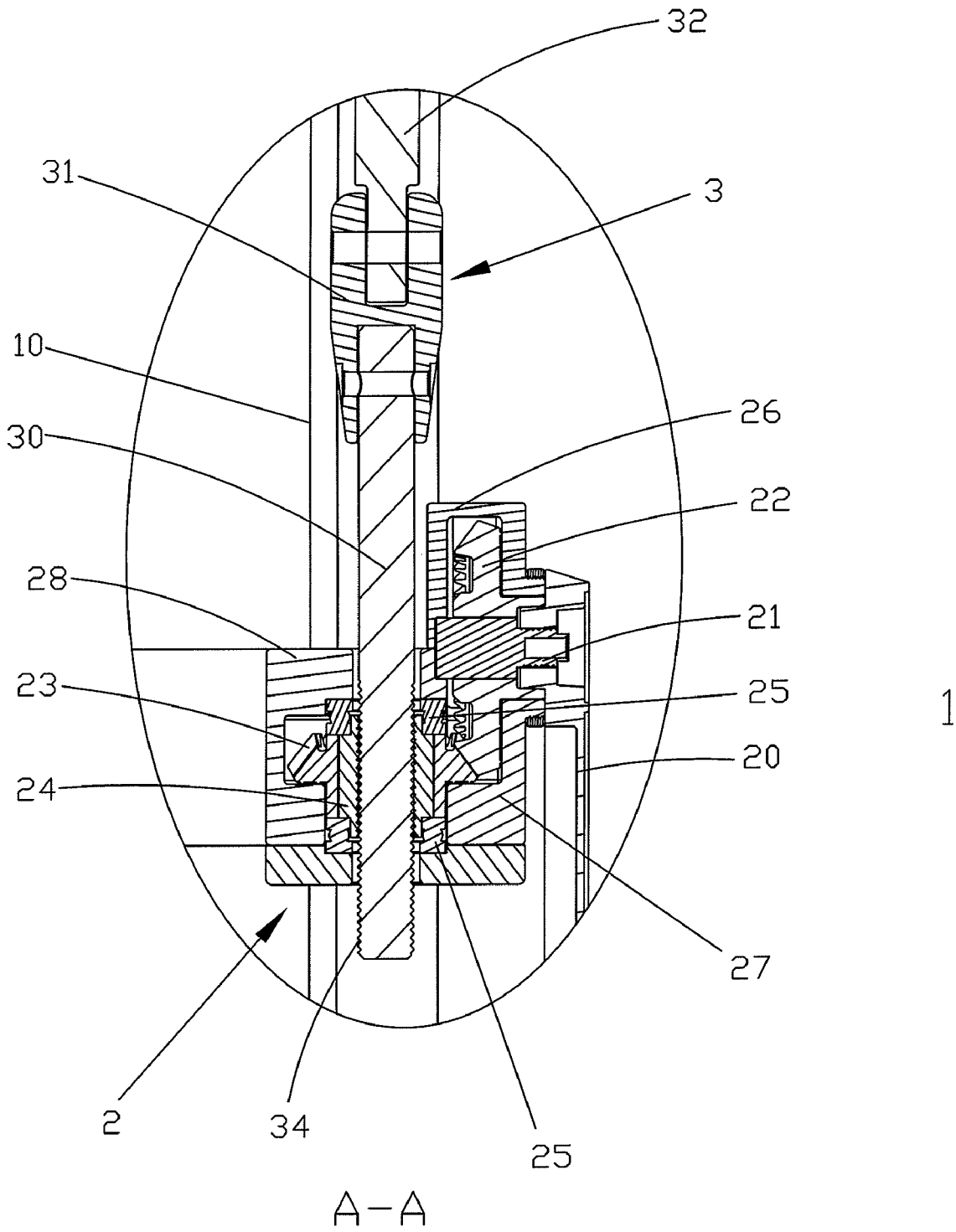
FIG. 3 is a locally enlarged view of the umbrella taken along an oblong mark "A-A" as shown in FIG. 2.
Figure 4:
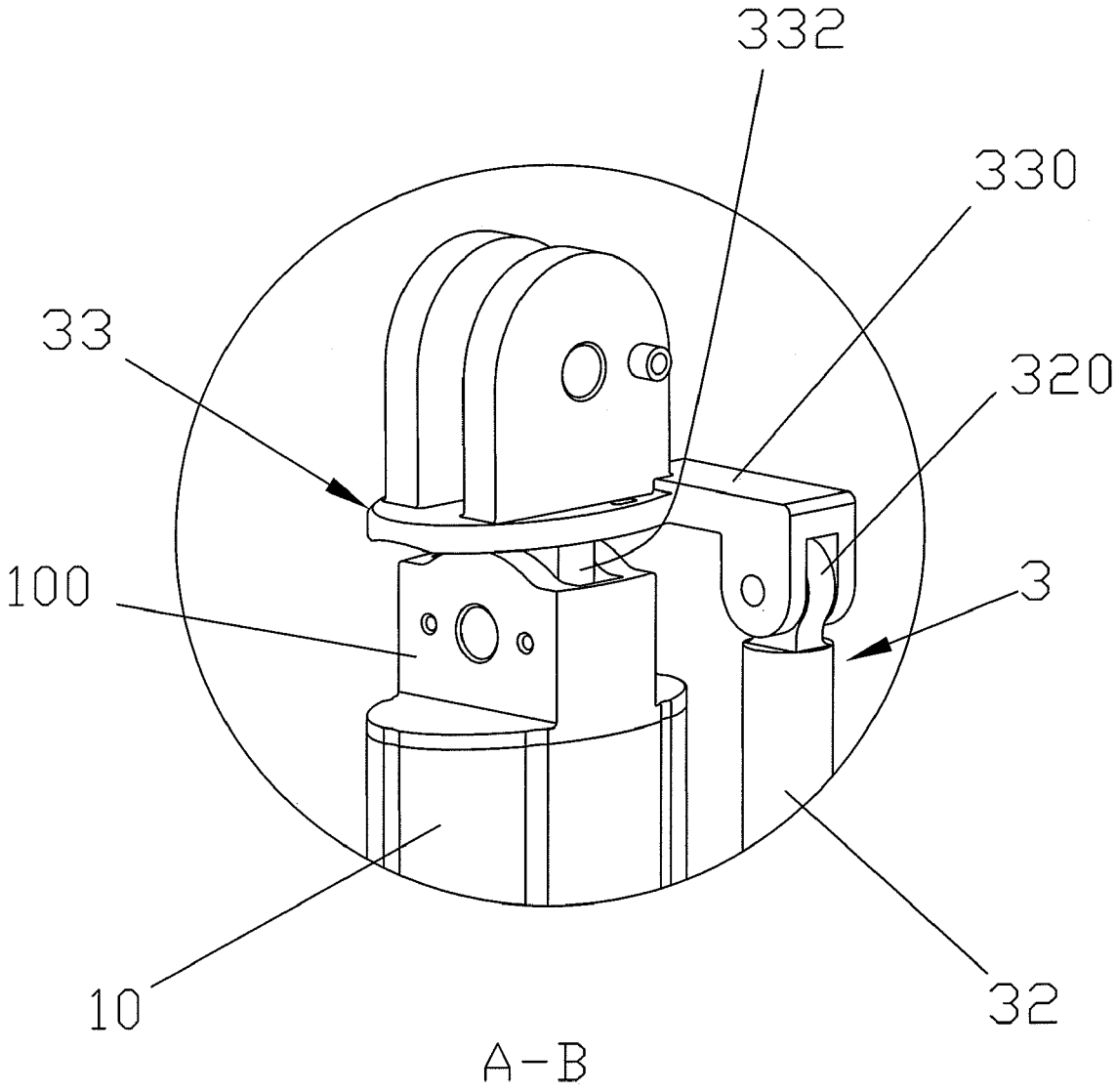
FIG. 4 is a locally perspective enlarged view of the umbrella taken along an oblong mark "A-B" as shown in FIG. 2.
Figure 5:
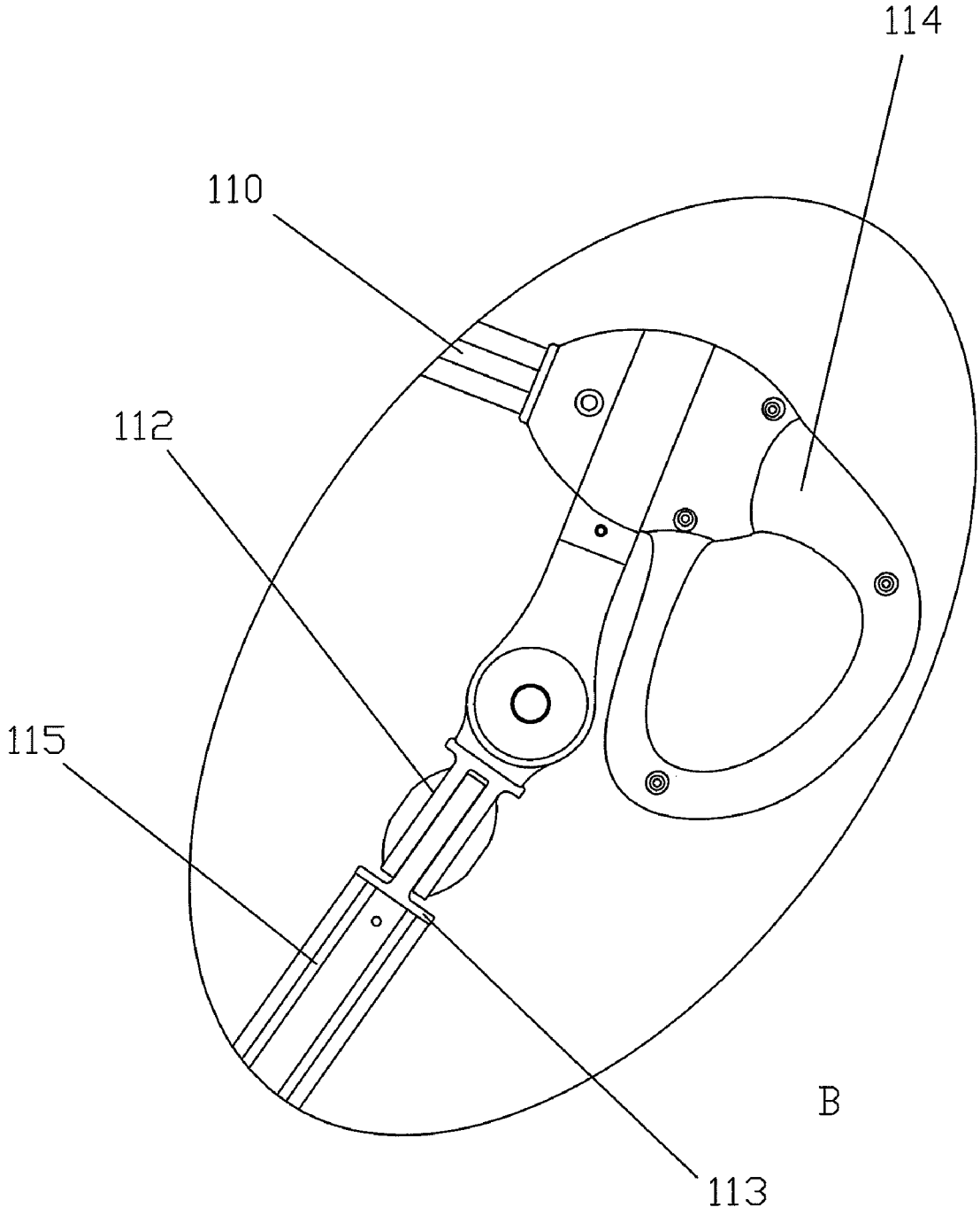
FIG. 5 is a locally enlarged view of the umbrella taken along an oblong mark "B" as shown in FIG. 1.

Referring to the drawings and initially to FIGS. 1-6, an umbrella in accordance with the preferred embodiment of the present invention comprises an upright post 10, a swing mechanism 3 pivotally mounted on the upright post 10, a frame 11 mounted on the swing mechanism 3 to pivot in concert with the swing mechanism 3 relative to the upright post 10, and a driving mechanism 2 mounted on the upright post 10 and connected with the swing mechanism 3 to drive the swing mechanism 3 to pivot relative to the upright post 10.

The upright post 10 has an upper end provided with a reduced hollow mounting portion 100.

The swing mechanism 3 includes a pivot seat 33 pivotally mounted on the upright post 10, a pull bar 32 having an upper end pivotally connected with the pivot seat 33 to drive the pivot seat 33 to pivot relative to the upright post 10, a driven rod 30 having an upper end connected with a lower end of the pull bar 32 to drive and move the pull bar 32 and a lower end that is driven by the driving mechanism 2 to move upward and downward relative to the upright post 10, and a connector 31 mounted between the lower end of the pull bar 32 and the upper end of the driven rod 30.

The pivot seat 33 of the swing mechanism 3 has a bottom provided with a pivot plate 332 inserted into and pivotally mounted on the mounting portion 100 of the upright post 10. The pivot seat 33 of the swing mechanism 3 has a top provided with a recessed fixing portion 331 for mounting the frame 11. The pivot seat 33 of the swing mechanism 3 has a side provided with a forked connecting portion 330. The connecting portion 330 of the pivot seat 33 is spaced from the pivot plate 332 of the pivot seat 33. The pull bar 32 of the swing mechanism 3 is parallel with the upright post 10. The upper end of the pull bar 32 is provided with a pivot ear 320 pivotally connected with the connecting portion 330 of the pivot seat 33. The driven rod 30 of the swing mechanism 3 is parallel with the upright post 10 and is in line with the pull bar 32. The lower end of the driven rod 30 is provided with an outer thread 34.

The driving mechanism 2 includes a housing 28 secured to the upright post 10, a driven nut 24 rotatably mounted in the housing 28 and screwed onto the outer thread 34 of the driven rod 30, a driven gear 23 rotatably mounted in the housing 28 and secured on the driven nut 24 to drive the driven nut 24 to rotate relative to the driven rod 30, a drive gear 22 meshing with the driven gear 23 to drive the driven gear 23 to rotate relative to the driven rod 30, a propeller shaft 21 secured on the drive gear 22 to rotate the drive gear 22, and a rocker arm 20 secured on the propeller shaft 21 to rotate the propeller shaft 21. The driving mechanism 2 further includes two bearings 25 mounted in the housing 28 and abutting two opposite sides of the driven gear 23 and two opposite sides of the driven nut 24 respectively to limit the driven gear 23 and the driven nut 24 in the housing 28. The driving mechanism 2 further includes a side cover 27 combined with the housing 28 and abutting the driven gear 23 and the drive gear 22, and a top cover 26 combined with the side cover 27 and abutting the drive gear 22 and the propeller shaft 21.

The housing 28, the side cover 27 and the top cover 26 of the driving mechanism 2 co-operate to cover the driven gear 23, the drive gear 22 and the propeller shaft 21. The drive gear 22 and the propeller shaft 21 of the driving mechanism 2 are limited between the side cover 27 and the top cover 26. The rocker arm 20 of the driving mechanism 2 is located outside of the side cover 27 and the top cover 26. Each of the driven gear 23 and the drive gear 22 of the driving mechanism 2 is a bevel gear. The driven gear 23 and the driven nut 24 of the driving mechanism 2 are limited by the two bearings 25 so that the driven gear 23 and the driven nut 24 of the driving mechanism 2 are non-movable axially relative to the driven rod 30. The driven nut 24 of the driving mechanism 2 is located in a central portion of the driven gear 23. The propeller shaft 21 of the driving mechanism 2 is located in a central portion of the drive gear 22.

The frame 11 includes a mounting bracket 111 secured on and supported by the fixing portion 331 of the pivot seat 33, a support shank 110 extending through the mounting bracket 111, a skeleton 116 mounted on an upper end of the support shank 110, a grip portion 114 mounted on a lower end of the support shank 110, and an elbow link 115 having a lower end pivotally connected with the upright post 10 and an upper end pivotally connected with the grip portion 114. The upper end of the elbow link 115 of the frame 11 is provided with a pivot base 113, and the grip portion 114 of the frame 11 has a lower end provided with an universal connector 112 pivotally mounted on the pivot base 113 of the elbow link 115.

Figure 6:
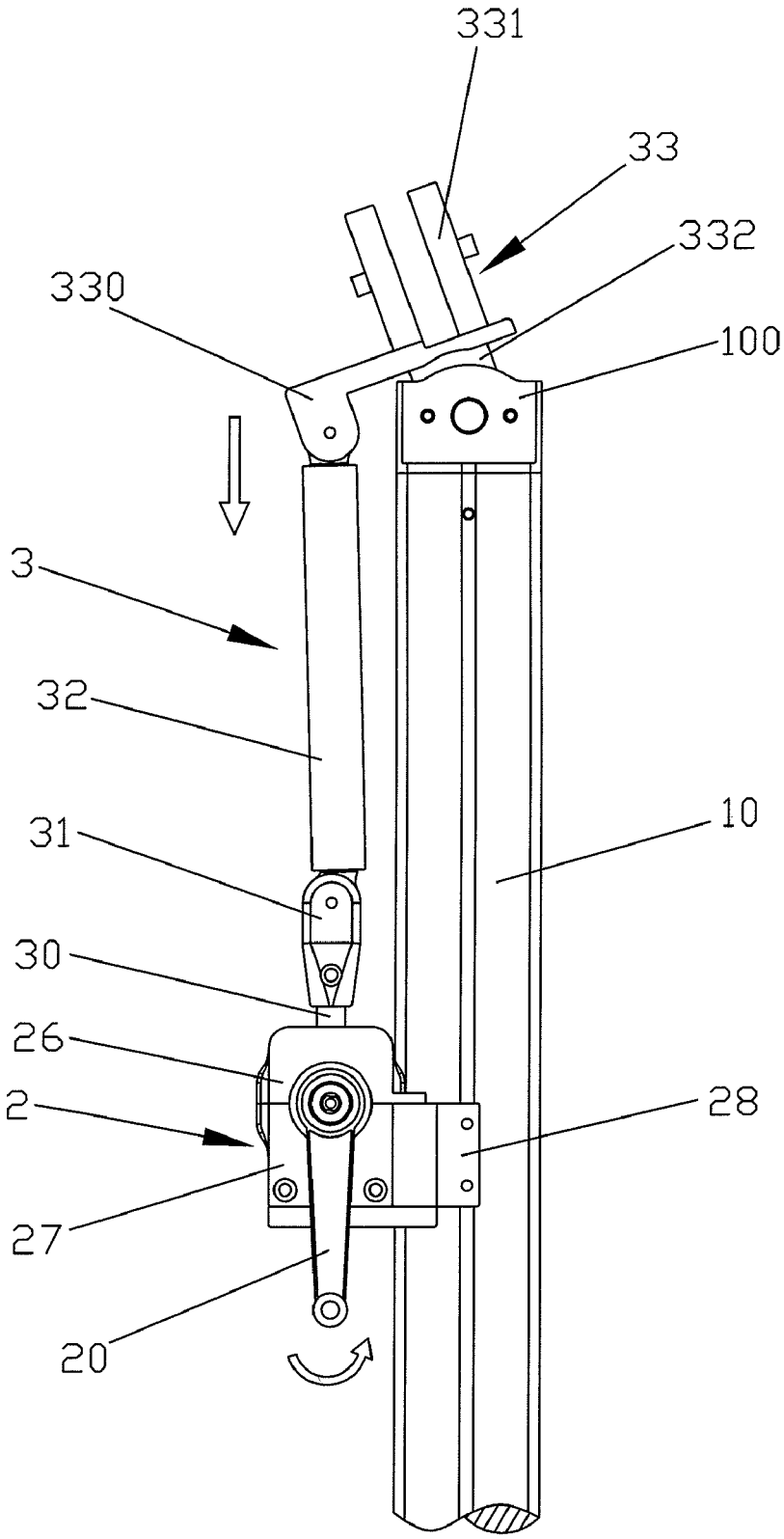
FIG. 6 is a partially rear enlarged operational view of the umbrella as shown in FIG. 1.
Figure 7:
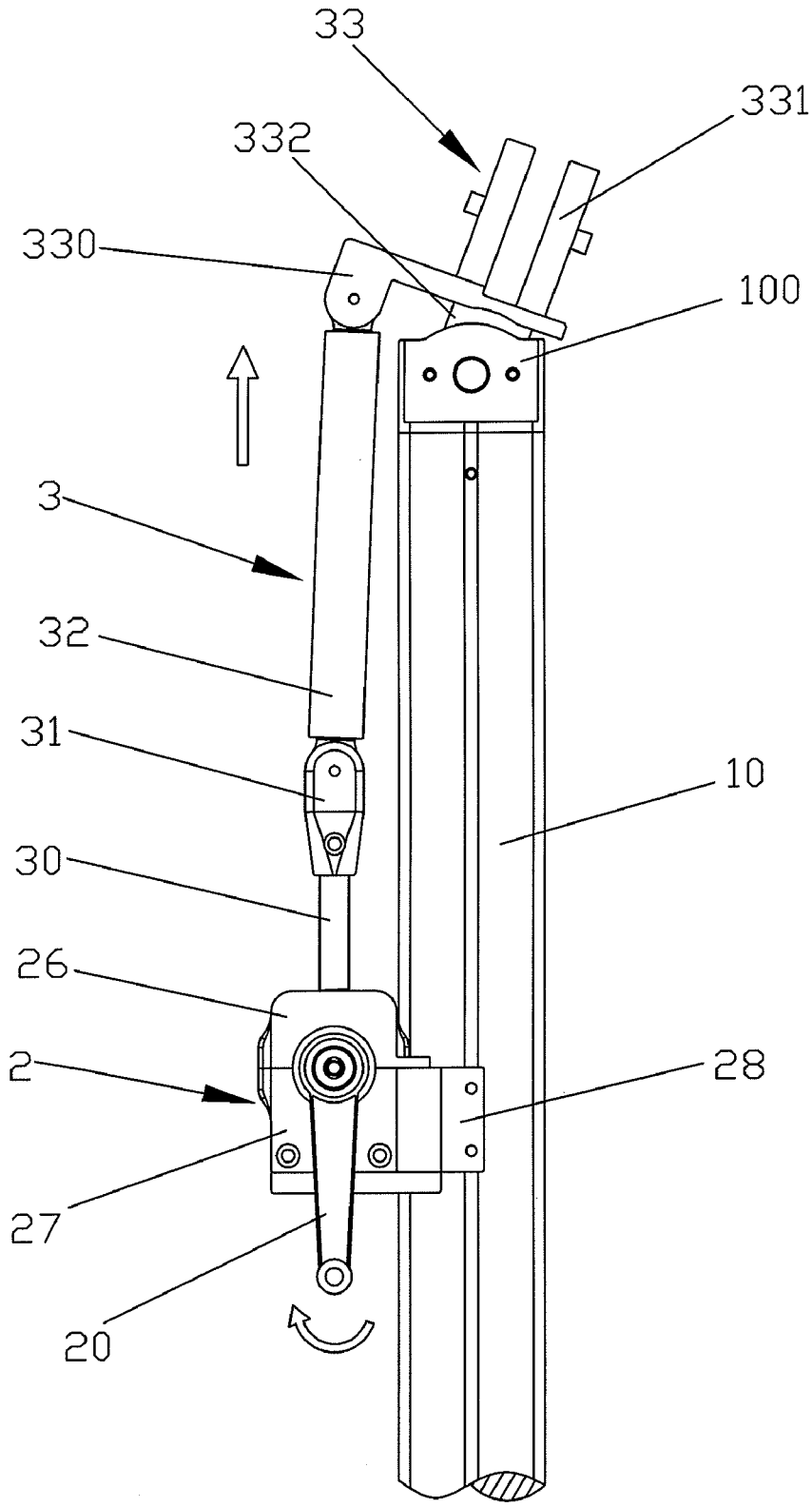
FIG. 7 is a partially rear enlarged operational view of the umbrella as shown in FIG. 1.
Figure 9:
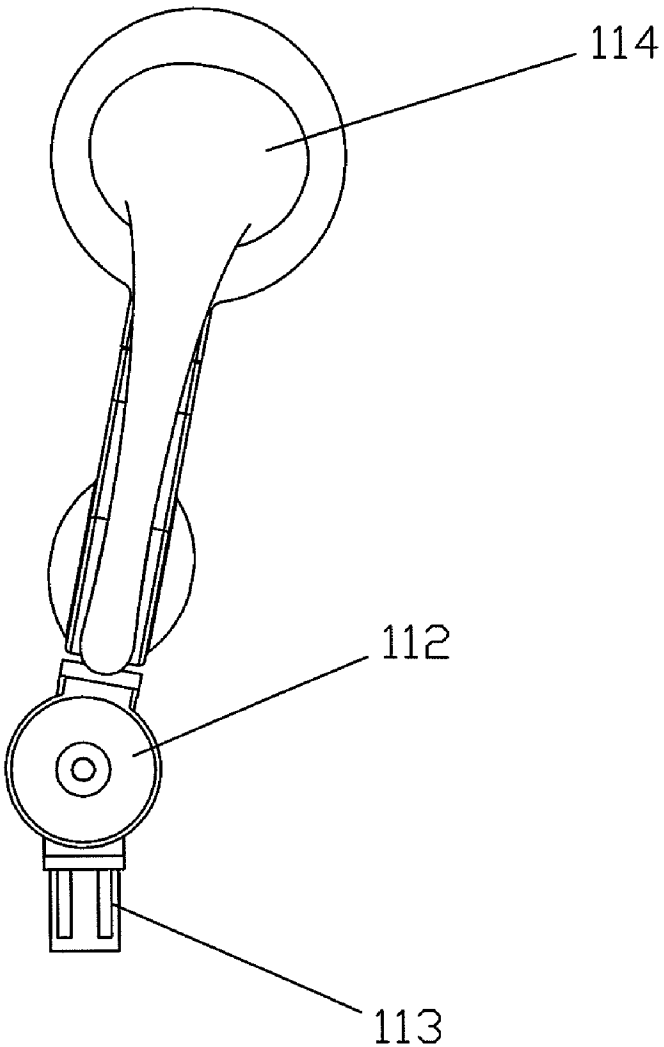
FIG. 9 is a rear operational view of the umbrella as shown in FIG. 5.
Figure 8:
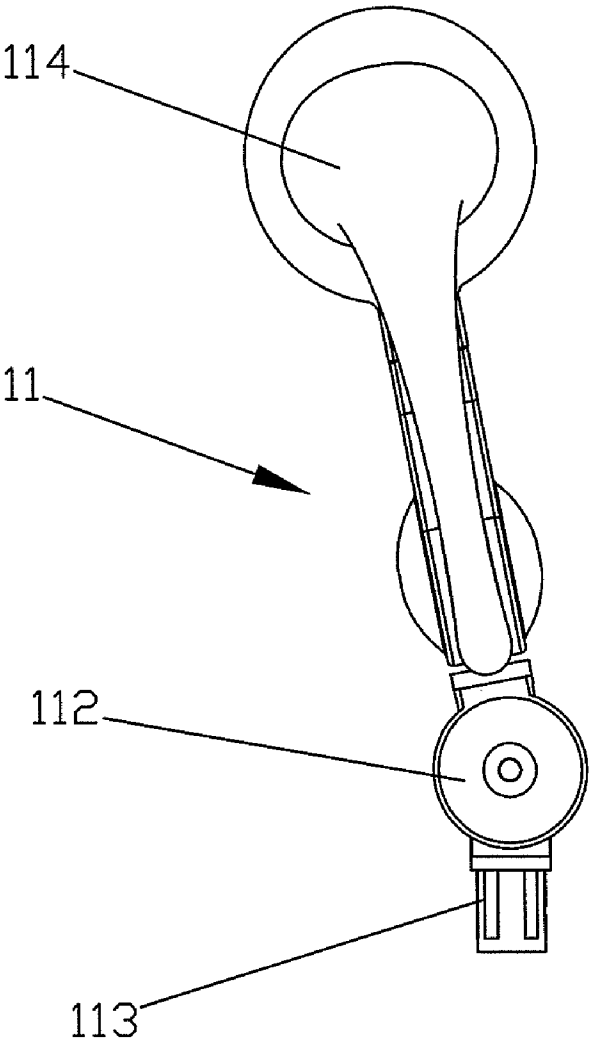
FIG. 8 is a rear operational view of the umbrella as shown in FIG. 5.
Figure 10:
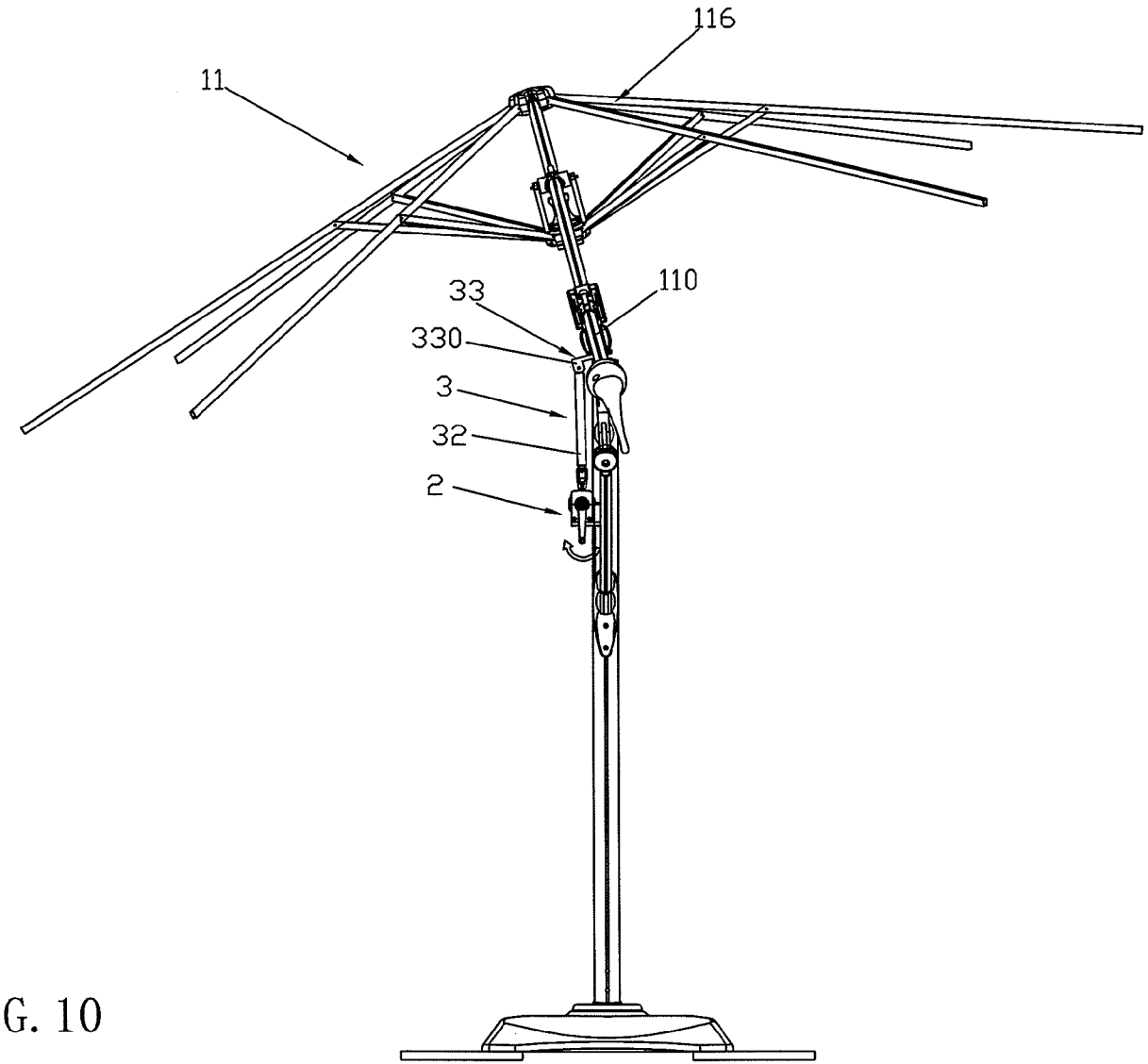
FIG. 10 is a rear operational view of the umbrella as shown in FIG. 1.
Figure 11:
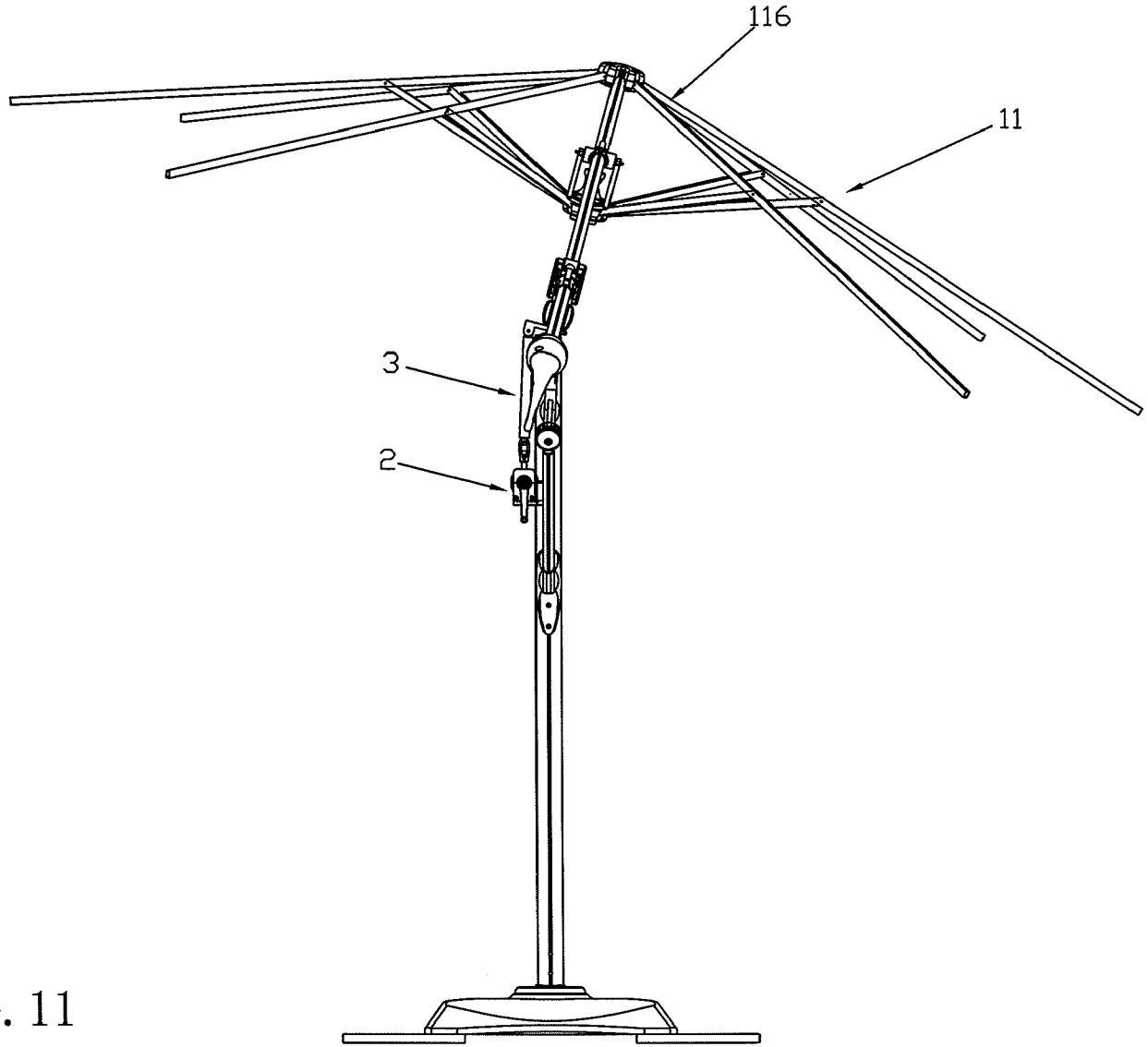
FIG. 11 is a rear operational view of the umbrella as shown in FIG. 1.

In operation, referring to FIGS. 6-11 with reference to FIGS. 1-5, when the rocker arm 20 is driven by a user, the propeller shaft 21 is rotated by the rocker arm 20 to rotate the drive gear 22 which rotates the driven gear 23 which rotates the driven nut 24 so that the driven nut 24 is rotated relative to the driven rod 30 to drive the driven rod 30 to move relative to the upright post 10 by a screwing engagement between the outer thread 34 of the driven rod 30 and the driven nut 24. In such a manner, the driven rod 30 is moved upward or downward relative to the upright post 10 to move the pull bar 32 which moves the connecting portion 330 of the pivot seat 33 so that the pivot seat 33 is driven to pivot on the mounting portion 100 of the upright post 10 leftward or rightward as shown in FIGS. 6 and 7, and the support shank 110 is moved and rolled by the pivot seat 33 to move the skeleton 116. Thus, the skeleton 116 of the frame 11 is moved and rolled relative to the upright post 10 to tilt leftward as shown in FIG. 10 or rightward as shown in FIG. 11 to adjust the inclined angle the skeleton 116 of the frame 11 so as to provide a better shading effect. At this time, the grip portion 114 of the frame 11 is also moved and rolled in concert with the support shank 110 to tilt leftward as shown in FIG. 8 or rightward as shown in FIG. 9.

Accordingly, the frame 11 is rolled relative to the upright post 10 to tilt leftward or rightward to adjust the inclined angle of the skeleton 116 of the frame 11 so as to provide a better shading effect. In addition, the user only needs to drive the rocker arm 20 to change and adjust the inclined angle of the frame 11, so that the inclined angle of the frame 11 can be adjusted easily and quickly.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An umbrella, comprising:

an upright post;

a swing mechanism pivotally mounted on the upright post;

a frame mounted on the swing mechanism to pivot in concert with the swing mechanism relative to the upright post;

a driving mechanism mounted on the upright post and connected with the swing mechanism to drive the swing mechanism to pivot relative to the upright post;

wherein the swing mechanism includes:

a pivot seat pivotally mounted on the upright post for mounting the frame;

a pull bar having an upper end pivotally connected with the pivot seat to drive the pivot seat to pivot relative to the upright post;

a driven rod having an upper end connected with a lower end of the pull bar to drive and move the pull bar that is driven by the driving mechanism to move upward and downward relative to the upright post;

the lower end of the driven rod is provided with an outer thread;

the driving mechanism includes:

a housing secured to the upright post to allow passage of the driven rod;

a driven nut rotatably mounted in the housing and screwed onto the outer thread of the driven rod;

a driven gear rotatably mounted in the housing and secured on the driven nut to drive the driven nut to rotate relative to the driven rod;

a drive gear meshing with the driven gear to drive the driven gear to rotate relative to the driven rod;

a propeller shaft secured on the drive gear to rotate the drive gear;

a rocker arm secured on the propeller shaft to rotate the propeller shaft.

2. The umbrella of claim 1, wherein the driving mechanism further includes:

two bearings mounted in the housing and abutting two opposite sides of the driven gear and two opposite sides of the driven nut respectively to limit the driven gear and the driven nut in the housing;

the two bearings are located outside of the upright post;

the driven rod is extended through and movable axially in the housing.

3. The umbrella of claim 2, wherein the driven gear and the driven nut of the driving mechanism are limited by the two bearings;

the driven gear and the driven nut of the driving mechanism are non-movable axially relative to the driven rod.

4. The umbrella of claim 1, wherein the driving mechanism further includes:

a side cover combined with the housing and abutting the driven gear and the drive gear;

a top cover combined with the side cover and abutting the drive gear and the propeller shaft;

the driven rod is located outside of the upright post;

the driven nut is located outside of the upright post;

the driven nut is disposed between the driven gear and the driven rod;

the driven gear surrounds the driven nut;

the top cover is located outside of the upright post.

5. The umbrella of claim 4, wherein the housing, the side cover and the top cover of the driving mechanism co-operate to cover the driven gear, the drive gear and the propeller shaft.

6. The umbrella of claim 4, wherein the drive gear and the propeller shaft of the driving mechanism are limited between the side cover and the top cover.

7. The umbrella of claim 4, wherein the rocker arm of the driving mechanism is located outside of the side cover and the top cover.

8. The umbrella of claim 1, wherein the pivot seat of the swing mechanism has a top provided with a recessed fixing portion for mounting the frame;

the frame includes:

a mounting bracket secured on and supported by the fixing portion of the pivot seat to pivot and move in concert with the fixing portion of the pivot seat;

a support shank extending through and adjustably mounted on the mounting bracket;

a grip portion mounted on a lower end of the support shank;

an elbow link having a lower end pivotally connected with the upright post and an upper end pivotally connected with the grip portion.

9. The umbrella of claim 8, wherein the frame further includes:

a skeleton mounted on an upper end of the support shank.

10. The umbrella of claim 8, wherein the upper end of the elbow link of the frame is provided with a pivot base;

the grip portion of the frame has a lower end provided with an universal connector pivotally mounted on the pivot base of the elbow link.

11. The umbrella of claim 1, wherein the upright post has an upper end provided with a reduced hollow mounting portion;

the pivot seat of the swing mechanism has a bottom provided with a reduced pivot plate inserted into and pivotally mounted on the mounting portion of the upright post.

12. The umbrella of claim 11, wherein the pivot seat of the swing mechanism has a side provided with a forked connecting portion which extends and faces downward;

the upper end of the pull bar is provided with a pivot ear pivotally mounted in and connected with the connecting portion of the pivot seat.

13. The umbrella of claim 12, wherein the connecting portion of the pivot seat is spaced from and located above the pivot plate of the pivot seat.

14. The umbrella of claim 1, wherein the swing mechanism further includes:

a connector pivotally mounted between the lower end of the pull bar and the upper end of the driven rod so that the pull bar is pivotally connected with the driven rod.

15. The umbrella of claim 1, wherein the pull bar of the swing mechanism is parallel with the upright post.

16. The umbrella of claim 15, wherein the driven rod of the swing mechanism is parallel with the upright post and is in line with the pull bar.

17. The umbrella of claim 1, wherein each of the driven gear and the drive gear of the driving mechanism is a bevel gear.

18. The umbrella of claim 1, wherein the driven nut of the driving mechanism is located in a central portion of the driven gear;

the propeller shaft of the driving mechanism is located in a central portion of the drive gear.

* * * * *